US007253701B2

(12) United States Patent
Smith et al.

(10) Patent No.: US 7,253,701 B2
(45) Date of Patent: Aug. 7, 2007

(54) MULTIPLEXED AMPLIFIER

(75) Inventors: Andrew D. Smith, Rancho Palos Verdes, CA (US); Barry R. Allen, Rolling Hills Estates, CA (US)

(73) Assignee: Northrop Grumman Corporation, Los Angeles, CA (US)

( * ) Notice: Subject to any disclaimer, the term of this patent is extended or adjusted under 35 U.S.C. 154(b) by 50 days.

(21) Appl. No.: 10/999,849

(22) Filed: Nov. 30, 2004

(65) Prior Publication Data

US 2007/0152747 A1 Jul. 5, 2007

(51) Int. Cl.
*H01P 5/12* (2006.01)

(52) U.S. Cl. ..... 333/100; 333/125; 333/136

(58) Field of Classification Search ..... 333/100, 333/125, 136

See application file for complete search history.

(56) References Cited

U.S. PATENT DOCUMENTS 3,768,043 A * 10/1973 Foldes ..... 333/135
3,863,078 A * 1/1975 Zappe ..... 307/404
4,749,888 A * 6/1988 Sakai et al. ..... 326/4
5,065,096 A * 11/1991 Muck et al. ..... 324/248
5,335,363 A * 8/1994 Basciano ..... 455/73
5,378,999 A * 1/1995 Martens et al. ..... 333/295
5,745,846 A * 4/1998 Myer et al. ..... 455/209
5,867,024 A * 2/1999 Zhang ..... 324/248
5,880,647 A * 3/1999 Kim ..... 333/99 S
5,912,472 A * 6/1999 Voigtlaender et al. ..... 257/31
5,936,458 A * 8/1999 Rylov ..... 327/528
6,107,898 A * 8/2000 Rauscher ..... 333/175
6,157,329 A * 12/2000 Lee et al. ..... 341/133
6,724,216 B2 * 4/2004 Suzuki et al. ..... 326/3

FOREIGN PATENT DOCUMENTS

JP 60254908 * 12/1985
JP 4097602 * 3/1992
JP 5267732 * 10/1993
JP 6224638 * 8/1994

* cited by examiner

*Primary Examiner*—Robert Pascal
*Assistant Examiner*—Kimberly E Glenn
(74) *Attorney, Agent, or Firm*—Tarolli, Sundheim, Covell & Tummino LLP

(57) ABSTRACT

Multiple sensor signals are used to modulate an equal number of frequency-spaced carrier signals in a directional parametric upconverting amplifier. Basically, the carrier signals are separated in a cascaded or parallel configuration of narrow frequency passbands, which also modulate the carrier signals with low-frequency sensor signals. The modulated carrier signals are multiplexed and output over a single signal path, thereby reducing power dissipation. Preferably implemented in superconducting circuitry, the multiplexed amplifier facilitates multiplexing of as many as hundreds of sensor signals and achieves both amplification and upconverting with minimal dissipation of power.

10 Claims, 3 Drawing Sheets

MULTIPLEXED AMPLIFIER

This invention was made with Government support under Subagreement Number SA3315. The Government has certain rights in this invention.

BACKGROUND OF THE INVENTION

This invention relates generally to multiplexed amplifiers and, more particularly, to multiplexed amplifiers that operate at very low temperatures and are suitable for use on a space platform. Various X-ray and millimeter-wave cameras are under development for use in earth observation and space exploration. The most sensitive of these cameras are cryogenic. If the detector elements of a camera can be cooled below 10 Kelvin, the thermal mass of the individual pixels can be reduced to such a degree that individual photons can be detected by the resulting temperature rise of the corresponding detector elements.

Low operating temperatures dictate low available cooling power on the sensor or detector stage of these low-temperature cameras. In a detector stage having thousands of pixels, meeting these cooling constraints requires controlling the amount of heat leaking through wires connecting to the detector elements, and controlling the amount of heat dissipated in detector readout amplifiers. It has been recognized that controlling the heat leaked through the detector connecting wires and the heat dissipated in detector readout amplifiers can be effected by minimizing the number of connecting wires and readout amplifiers. Efforts have been made to reduce heat loads by multiplexing multiple detectors to shared amplifiers and wiring. For example, it has been proposed to use time division multiplexing (TDM) to sample up to 32 pixels of a detector stage sequentially through a common Superconducting Quantum Interference Device (SQUID) amplifier. Each pixel includes a SQUID on/off switch that performs the multiplexing operation. Another approach uses frequency domain multiplexing (FDM) to stimulate each of up to 32 pixels at a different frequency. The summed signal is amplified with a SQUID amplifier. Both these prior art techniques are significantly limited because only 32 pixels per amplifier may be multiplexed, and there is still a need to dissipate power in the SQUID circuitry.

Accordingly, what is needed is a multiplexer/amplifier that can handle many more than 32 pixels, can be conveniently located on the sensor platform, and will dissipate very low power. The present invention achieves these and other goals.

SUMMARY OF THE INVENTION

The present invention resides in a multiplexer/amplifier that multiplexes a hundred or more low frequency signals simultaneously onto a single transmission line while dissipating only a small amount of electrical power. Briefly, the invention uses parametric upconversion to modulate a microwave carrier, with each signal channel modulating a dedicated and unique carrier frequency. A resonant frequency multiplexer structure accepts a common input line for the carriers, separates and isolates the individual channels, and recombines the output into a common output line.

Briefly, and in general terms, the multiplexed amplifier comprises a plurality (N) of signal input paths for input of multiple sensor signals; a high frequency input path for inputting a comb of N frequency-spaced carrier signals; a structure having multiple narrowband filters connected in such a way as to separate the carrier signals into N distinct transmission paths; means for modulating each of the N carrier signals with a respective one of the N input sensor signals; and means for coupling the modulated N carrier signals onto a single output path.

Preferably, the amplifier structure uses superconducting components, which facilitate narrowband filtering and perform amplification and upconversion with minimal power dissipation. Moreover, because the amplifier is capable of multiplexing a large number input signals onto a single output line, power dissipation that results from using multiple connection lines is avoided.

In a specific embodiment of the amplifier, the structure having multiple narrowband filters comprises N parallel distributed Josephson inductance (DJI) transmission lines configured as resonators, the resonators having center frequencies corresponding to the frequencies of the N carrier signals. The N signal input paths are coupled to the N resonators and function to modulate the respective carrier signals input to the resonators; and the means for coupling the modulated N carrier signals onto a single output path comprises a set of transmission lines, each of which couples signals from a respective resonator to the single output path.

In another preferred embodiment of the invention the structure having multiple narrowband filters comprises N ring resonators, each of which includes a distributed Josephson inductance (DJI) transmission line, the ring resonators having center frequencies corresponding to the respective frequencies of the N carrier signals. The ring resonators are connected in cascade and each ring resonator provides a direct connection to the next cascaded ring resonator for input carrier signals other than the one corresponding to the center frequency of this ring resonator, and provides a connection through the resonator to the single output path for the carrier signal corresponding with the center frequency of this ring resonator. The means for modulating a particular carrier signal comprises the ring resonator corresponding to the center frequency of that carrier signal, and means for coupling a respective input signal to the ring resonator.

Each ring resonator preferably comprises two coupled DJI transmission lines, each configured as a ring. More specifically, each ring resonator further comprises a first terminal for receiving at least one of a comb of frequencies from the high-frequency input path; a second terminal for coupling out-of-band high-frequency signals directly to the first terminal of a downstream ring resonator when those high-frequency signals do not match the center frequency of this resonator; a third terminal for coupling in-band high-frequency signals directly to the single output path when those high-frequency signals match the center frequency of this resonator; and a fourth terminal for transmitting onto the single output path out-of-band high-frequency signals received as output signals from a downstream ring resonator. The high-frequency input path connects the first and second terminals of cascaded ring filters and the single output path connects the third and fourth terminals of the cascaded ring filters.

The invention may also be defined in terms of a method for multiplexing, amplifying and upconverting a plurality (N) of low-frequency input signals. Briefly, the method comprises the steps of inputting a plurality (N) of frequency-spaced high-frequency tones along a single input path into an amplifier structure; separating the N high-frequency tones to propagate along N separate transmission paths, using a plurality of narrowband structures; inputting N low-frequency input signals into the amplifier structure; modulating the high-frequency tones with respective ones of the low-frequency signals, to provide N modulated high-frequency tones on separate transmission paths; and combining the N modulated high-frequency tones on a single output path.

It will be appreciated from the foregoing summary that the present invention represents a significant advance in the field of multiplexed amplifiers and upconverters. In particular, the invention provides a greatly improved technique for connecting large numbers of sensor signals to a receiver, with minimal dissipation of power. Other aspects and advantages of the invention will become apparent from the following more detailed description, considered in conjunction with the accompanying drawings.

DETAILED DESCRIPTION OF THE INVENTION

Figure 1:
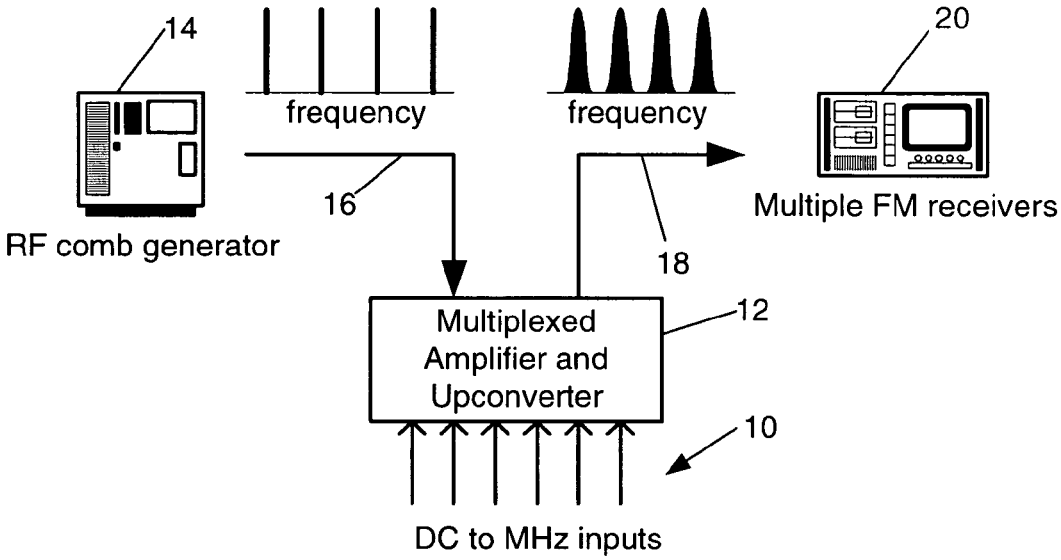
FIG. 1 is block diagram showing environment of the present invention.

As shown in the drawings for purposes of illustration, the present invention is concerned with a multiplexer/amplifier structure that can multiplex the outputs of a large number of detector elements, and thereby dissipate very little power. Prior approaches to reducing power dissipation by multiplexing have been limited in the number of sensor pixels that can be multiplexed in one amplifier, and have been accordingly limited in their effectiveness.

In accordance with the present invention, these limitations of the prior art have been overcome and the invention facilitates multiplexing of a large number, such as a hundred or more, of low-frequency signals simultaneously onto a single transmission line, while dissipating only a small amount of electrical power.

FIG. 1 depicts the principle of the invention. An array of input signals, indicated at 10, is received from a source such as an array of detector elements in an X-ray or millimeter-wave camera (not shown). Each picture element, or pixel, in the detector array provides an electrical signal constituting one of the input signals 10. Typically, the input signals are slowly varying, and are referred to in the figure as DC to megahertz (MHz) signals. The input signals 10 are coupled to a multiplexed amplifier and upconverter 12, which receives as additional inputs a comb of radio frequency (rf) signals, with frequencies measured in gigahertz (GHz). The comb of rf signals is generated in a conventional rf comb generator 14 and is coupled to the multiplexed amplifier and upconverter 12 over line 16. The term "comb" is often applied to describe multiple frequency tones that are uniformly spaced from each other in the frequency spectrum. For example, the comb of rf signals may include one signal at 4.000 GHz, another at 4.010 GHz, another at 4.020 GHz, and so forth. The function of the multiplexed amplifier and upconverter 12 is to modulate each tone in the rf comb with a separate one of the input signals 10, and at the same time amplify the input signals. Thus, the output generated by the multiplexed amplifier and upconverter 12, on line 18, consists of a set of rf tones that are phase-modulated (FM) with respective input signals 10.

The input signals 10 are both amplified and upconverted in the multiplexed amplifier and upconverter 12. That is to say, the information contained in each of the signals 10 is phase-modulated onto a much higher frequency carrier signal. The modulated tones on line 18 are effectively frequency division multiplexed (FDM) and are then coupled, as desired for a particular application, to multiple FM receivers 20. The nature of the receivers 20 forms no part of the present invention, but it will be appreciated that the invention provides a technique for multiplexing a large of number of signals 10 onto a single line for transmission to the receivers, thereby achieving the principal goal of the present invention, which is to minimize power and heat dissipation.

The multiplexed amplifier and upconverter 12 (referred to from this point on simply as "the amplifier") may take any of a number of different forms, some of which are described in this specification. Because all such implementations require some form of very narrowband filter, coupler or resonator device, it is most desirable, if not essential in some applications, that the amplifier 12 be implemented using superconducting devices. A useful building block in this regard is the distributed Josephson inductance (DJI) transmission line, which comprises many rf superconducting quantum interference devices (SQUIDs) coupled together to form an integrated-circuit transmission line. When a dc bias and an rf signal are applied to the DJI transmission line, it provides a controllable true time delay. A microwave carrier signal transmitted through the line is phase modulated by the baseband rf signal. In effect, the baseband signal is upconverted to the microwave frequency and amplified at the same time. The basic structure and operation of a DJI transmission line are described in U.S. Pat. No. 5,153,171, issued in the names of Andrew D. Smith et al., the disclosure of which is hereby incorporated by reference into this specification.

Figure 2:
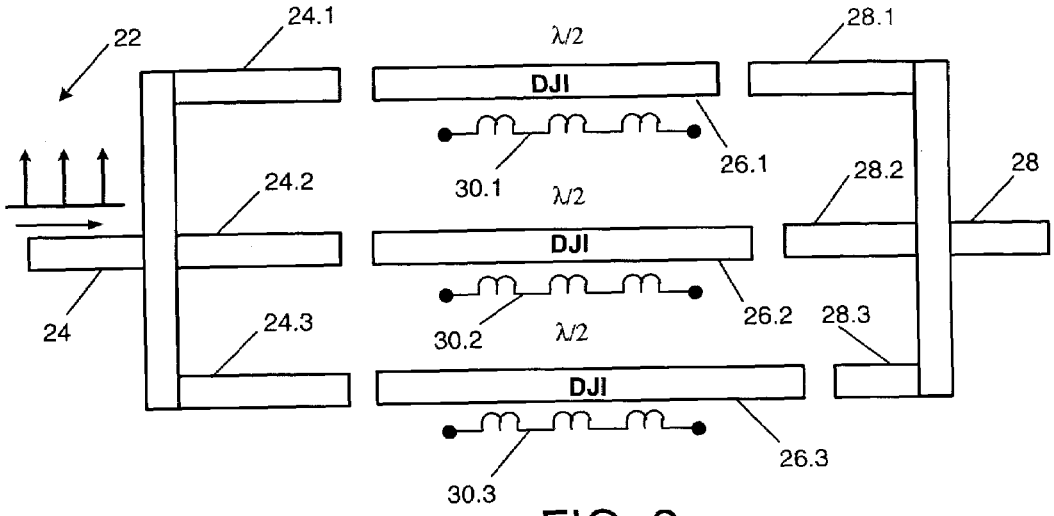
FIG. 2 is a diagrammatic view of one embodiment of the present invention, in which multiple resonators are connected in parallel to perform parametric resonant upconversion.

One implementation of the amplifier 12 is depicted in FIG. 2. A comb of rf signals, indicated at 22, is coupled into a transmission line 24, which is divided into multiple, parallel transmission lines, three of which are shown at 24.1, 24.2 and 24.3. Each of these parallel transmission lines is coupled into a separate DJI transmission line, the three DJI lines being shown at 26.1, 26.2 and 26.3, respectively. The DJI transmission lines 26.1, 26.2 and 26.3 are coupled, in turn, to three respective output transmission lines 28.1, 28.2 and 28.3, which are combined into a single output transmission line 28. The DJI transmission lines 26.1, 26.2 and 26.3 have lengths of one half-wavelength of the three respective signals in the rf comb 22. The DJI transmission lines also have associated coupling circuits 30.1, 30.2 and 30.3, through which the respective input signals (10 in FIG. 1) are coupled.

The rf input signals on input transmission line 24 are separately phase modulated in the DJI transmission lines 26.1, 26.2 and 26.3 and then combined in output transmission line 28 as multiple frequency division multiplexed signals. It will, of course, be understood that the implementation is not limited to three input signals.

The embodiment of FIG. 2 has a potential disadvantage in that there may be cross-coupling between the DJI filters, producing unwanted resonant modes in the output. This form of the invention is nevertheless a very useful one, given its simplicity of construction. Cross-coupling between filters can be minimized by sufficiently spacing the parallel transmission lines, which may be an acceptable solution in many applications.

Figure 3:
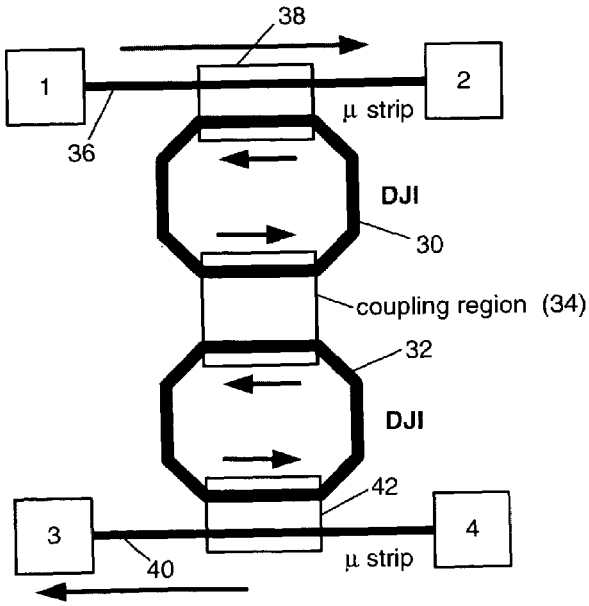
FIG. 3 is a diagrammatic view of a ring resonator directional coupler used in another embodiment of the present invention.

Another preferred embodiment of the invention employs DJI transmission lines in the form of ring resonators. FIG. 3 shows the principle of such a resonator in which a pair of DJI transmission lines 30 and 32 are each formed as a ring and are also coupled together as indicated by a coupling region 34. An input microstrip transmission line 36 extends between two terminals designated terminal #1 and terminal #2. The input transmission line 36 is coupled to the first DJI ring 30, as indicated by a coupling region 38. Similarly, an output microstrip transmission line 40 extends between terminals designated terminal #3 and terminal #4. This transmission line 40 is coupled to the other DJI ring 32, as indicated by another coupling region 42.

The pair of ring resonators 30 and 32 function as a directional filter. So long as the frequency of an rf signal input to terminal #1 is not within the narrow resonance band of the ring resonators 30 and 32, i.e., the rf signal is an out-of-band signal, then it is for the most part transmitted directly from terminal #1 to terminal #2 and not through the resonators. Similarly, an out-of-band signal input to terminal #4 is transmitted to terminal #3. This transmission of out-of-band signals is indicated by curve S12 in FIG. 4. If the rf signal falls within the narrow resonance band of the ring resonators 30 and 32, the in-band signal is for the most part coupled from terminal #1 to terminal #3, through the resonators. This switching of in-band signals is indicated by curve S13 in FIG. 4. Although two DJI rings 30 and 32 are depicted, the principle of the invention also applies to a configuration having only a single DJI ring resonator.

Figure 4:
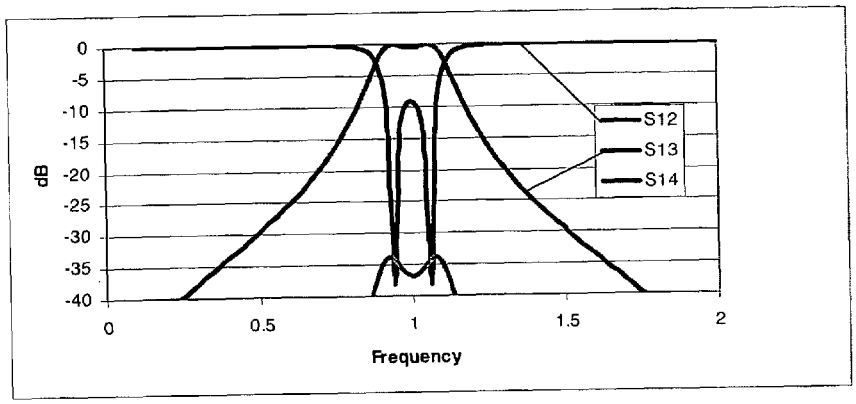
FIG. 4 is a graph illustrating the performance of the ring resonator of FIG. 3.
Figure 5:
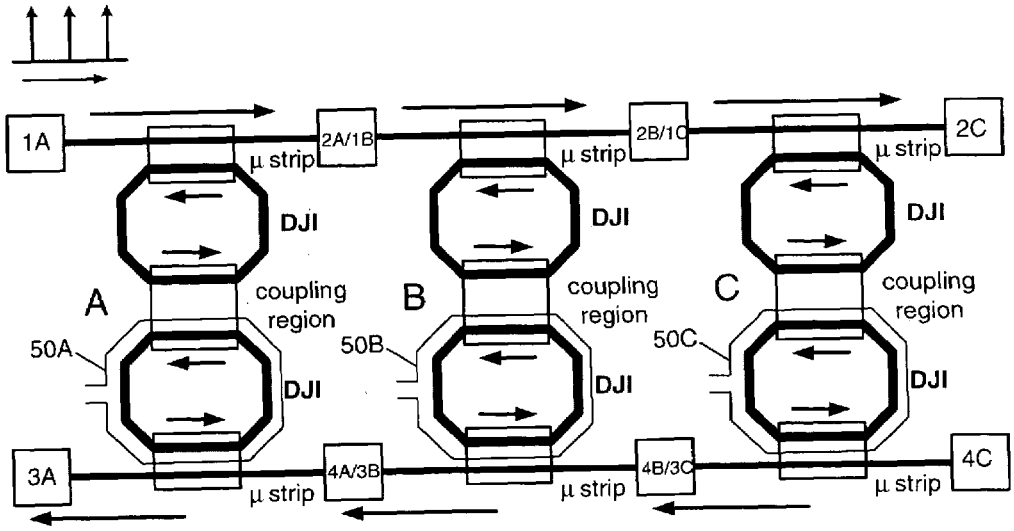
FIG. 5 is a diagrammatic view of an embodiment of the present invention in which multiple ring resonators are cascaded to perform multi-channel parametric resonant upconversion.

FIG. 5 depicts three dual-ring resonators of the type shown in FIG. 4, connected in a series string to perform amplification and upconversion of three input signals. For simplicity, the reference numerals used in FIG. 4 are not replicated three times in FIG. 5, but it will be understood that the component parts of each of the three dual-ring resonators are identical in structure to corresponding components shown in FIG. 4. For convenience in describing the three resonators, they are referred to as the A, B and C resonators. Also, for consistency in referring to the terminals of the three resonators, the A resonator terminals are designated 1A, 2A, 3A and 4A, the B resonator terminals are designated 1B, 2B, 3B and 4B, and the C resonator terminals are designated 1C, 2C, 3C and 4C. Since the three resonators are connected together in cascade, terminals 2A and 1B are shown as one terminal (2A/1B). Similarly, terminals 4A and 3B are shown as terminal 4A/3B, terminals 2B and 1C are shown as terminal 2B/1C, and terminals 4B and 3C are shown as terminal 4B/3C. The low-frequency input signals (10 in FIG. 1) are coupled to the three resonators A, B and C by any convenient means, such as through a conductive loop around one resonator ring of each dual resonator, as indicated diagrammatically at 50A, 50B and 50C. A comb of three microwave frequencies is input at terminal 1A. By way of example, the microwave frequencies may 4.000 GHz, 4.010 GHz and 4.020 GHz.

In operation, the first resonator A couples the 4.000 GHz microwave frequency from terminal 1A to terminal 3A and the DJI ring resonators in resonator A function to phase modulate the microwave frequency with the first low-frequency signal. The other two microwave frequencies are transmitted directly from terminal 1A to terminal 2A of resonator A.

In resonator B, a similar function is performed for the 4.010 GHz microwave frequency, which is coupled through resonator B, phase modulated with the respective low-frequency signal, and output on terminal 3B, from which it is transmitted back to output terminal 3A of resonator A. The 4.020 GHz microwave frequency input to terminal 1A is transmitted through terminal 2A/1B to terminal 2B/1C. This microwave signal is coupled through the remaining resonator (C), where it is phase modulated with the third of the low-frequency input signals, and output to terminal 4B/3C, from which it is transmitted directly through terminal 4A/3B to output terminal 3A.

Therefore, the signal output from terminal 3A is a set of phase modulated comb frequencies. The first microwave frequency is modulated in resonator A, the second in resonator B and the third in resonator C. The single output from terminal 3A may be coupled (via line 18 in FIG. 1) to an appropriate set of FM receivers (20 in FIG. 1) for further processing. The serial string of three resonators A, B and C may be extended to include a hundred or more such resonators using the principle of operation described above for three resonators. Alternative configurations are also possible, including parallel combinations of serial strings of resonators.

Design details of the FIG. 5 structure for a specific application are a matter of routine microwave engineering, using any of a number of available texts on the subject. For example, a widely used suitable text is "Microwave Filters, Impedance-Matching Networks and Coupling Structures," by G. Matthaei, E. M. T. Jones and L. Young, published by Artech House, Inc., Norwood, Mass. 02062.

It will appreciated from the foregoing that the core component of the invention is a directional coupler with a cascade of narrow microwave passbands. The directional coupling structure is designed with perhaps 0.1% bandwidths, separated by 1%. Thus the first channel could be 4.000+0.004 GHz, the second channel could be 4.040+0.004 GHz, the third channel 4.080+0.004 GHz, etc.

In operation, the rf comb generator 14 (FIG. 1) would, in this example, generate a comb of frequencies, exciting each of the filter loops (4.000, 4.040, 4.080 GHz), or whichever channels were needed to be interrogated.

The signals 10 (FIG. 1) are introduced through parametric amplification. Rather than using passive loops, the preferred embodiment of the invention uses loops with controllable phase velocity, as described above. Thus, the input current for a first channel controls the center frequency of the first channel resonator/coupler.

In one mode of operation, as described above with reference to FIG. 5, the first channel is excited with a carrier precisely equal to its center frequency. The carrier resonates with the channel loop and passes to the output line. When a low-frequency input signal is present at the same channel, the central frequency of the channel loop will change. A phase lag or lead will be impressed on the carrier progressing through the channel loop. Changing the resonant frequency of the loop will also induce some amplitude suppression as the loop departs from resonance. An FM receiver connected to the output is specifically tuned to this channel's carrier frequency. In the same manner, signals are modulated onto other channel carriers and demodulated by appropriate receivers.

In addition to encoding the input signal onto the carrier, the amplifier of the invention does an extremely good job of amplification. The amplification process belongs to the class of parametric upconverting amplifiers. Theoretical gains of parametric amplifiers are equal to the ratio of the carrier frequency (e.g., 4 GHz) to the signal frequency (e.g., 4 kHz), or a power gain of 1,000,000. At the same time, the parametric converter handles the amplification with reactive components, non-dissipatively. The cold platform power dissipation can be essentially zero with sufficiently high quality conductors and control elements.

Cryogenic operation and superconductivity make the invention particularly attractive. The basic resonator performance must be compatible with the channel spacing and channel bandwidths. A standard measure of resonator or filter performance is the width of its passband as measured by the factor Q, usually defined as the ratio of the center frequency to the difference between the frequencies measured at half the peak height of (or 3 dB below) the filter or resonator characteristic. In other words, Q is a measure of the ratio of height to width of the filter/resonator passband characteristic. For conventional, non-superconductive circuitry, filter Q values less than 100 are common. For superconducting resonators of the type described in this specification, Q values over 1,000 and as high as 3,000 or more are achievable. High Q values for the transmission lines and resonator loops assure high isolation between channels and low power dissipation within the system.

Another important consideration is that the integrated circuit chip "real estate" of each filter channel must be reasonably small to allow many channels to fit within convenient substrate sizes. Using a niobium integrated circuit process results in a 1-micron dielectric height, which allows a wiring pitch on the order of 10 microns. Entire one-wave transmission lines fit within a 1 $mm^2$ chip area at a frequency of 4 GHz. One hundred channels, for example, fit in an area not much larger than one square centimeter.

Another variant of the invention is to use variable capacitance (varactors) instead of variable inductance in the resonant loops. The amplifier of the invention may also employ feedback to adjust the microwave input signals to track the changing resonant frequency of the filter channels. Using feedback increases the dynamic range and linearity of the amplifier.

Although the invention has been described as processing analog low-frequency signals, the input signals could just as easily be digital in form, in which case a linear response in the resonator velocity is not required. A simple on/off switch would suffice. The digital case could include amplitude and phase modulation (quadrature amplitude modulation, QAM, for example) on multiple carriers, providing parallel encoding and transmission of digital data over the multiple carriers.

Similarly, although detection of the modulated signals is described as using FM receivers, detection may alternatively use amplitude modulation, phase modulation or vector modulation.

An important advantage of the invention is that parametric amplification has extremely low noise and high gain. Parametric amplifiers tend to work close to the quantum noise limit. At microwave frequencies, the world record for low noise amplification, at <0.1 kelvin, is a 0.002 dB noise figure. Most amplifiers dissipate 10–100× the peak amount of power they can handle, including SQUID amplifiers proposed in the prior art for the sensor multiplexing application. The present invention has only small parasitic loss It will be appreciated from the foregoing that the present invention represents a significant improvement in the art of multiplexing amplifiers that dissipate very low powers while providing an input path for hundreds of detector elements. It will also be appreciated that, although specific embodiments of the invention have been described in detail, various modifications may be made that are within the spirit and scope of the invention, as briefly described above. Accordingly, the invention should not be limited except as by the appended claims.

The invention claimed is:

1. A multiplexed amplifier for combining multiple modulated carriers on a single output path, the amplifier comprising:

a plurality (N) of signal input paths for input of a plurality of (N) input sensor signals;

a high frequency input path for inputting a comb of N frequency-spaced carrier signals;

a structure having multiple narrowband filters connected in such a way as to separate the carrier signals into N distinct transmission paths;

means for modulating each of the N carrier signals with a respective one of the N input sensor signals to provide N modulated carrier signals; and means for coupling the N modulated carrier signals onto the single output path.

2. A multiplexed amplifier as defined in claim 1, wherein:

the structure having the multiple narrowband filters comprises N parallel distributed Josephson inductance (DJI) transmission lines configured as resonators, the resonators having center frequencies corresponding to the frequencies of the N carrier signals;

the N signal input paths are coupled to the N resonators and function to modulate the respective carrier signals input to the resonators; and the means for coupling the N modulated carrier signals onto the single output path comprises a set of transmission lines, each of which couples signals from a respective one of said resonators to the single output path.

3. A multiplexed amplifier as defined in claim 1, wherein:

the structure having the multiple narrowband filters comprises N ring resonators, each of which includes a distributed Josephson inductance (DJI) transmission line, the N ring resonators having center frequencies corresponding to the respective frequencies of the N carrier signals;

the N ring resonators are connected in a cascade arrangement;

each of the N ring resonators provides a direct connection to a next one of the N ring resonators in the cascade arrangement for input carrier signals other than the one corresponding to the center frequency of a respective one of the N ring resonators, and provides a connection through the respective one of the N ring resonators to the single output path for the carrier signal corresponding with the center frequency of the respective one of the N ring resonators; and the means for modulating a particular one of said carrier signals comprises the respective one of the N ring resonators corresponding to the center frequency of that carrier signal, and means for coupling a respective one of said input signals to the respective one of the N ring resonators.

4. A multiplexed amplifier as defined in claim 3, wherein each ring resonator comprises two coupled DJI transmission lines, each configured as a ring.

5. A multiplexed amplifier as defined in claim 3, wherein each of the N ring resonators further comprises:

a first terminal for receiving at least one of a comb of frequencies from the high-frequency input path;

a second terminal for coupling out-of-band high-frequency signals directly to the first terminal of a downstream ring resonator when those high-frequency signals do not match the center frequency of the respective one of the N ring resonators;

a third terminal for coupling in-band high-frequency signals directly to the single output path when those high-frequency signals match the center frequency of the respective one of the N ring resonators; and a fourth terminal for transmitting onto the single output path out-of-band high-frequency signals received as output signals from the downstream ring resonator;

wherein the high-frequency input path connects the first and second terminals of the cascaded ring oscillators and the single output path connects the third and fourth terminals of the cascaded ring oscillators.

6. A method for multiplexing, amplifying and upconverting a plurality (N) of low-frequency input signals, the method comprising:

inputting a plurality (N) of frequency-spaced high-frequency tones along a single input path into an amplifier structure;

separating the N high-frequency tones to propagate along N separate transmission paths, using a plurality of narrowband structures;

inputting N low-frequency input signals into the amplifier structure;

modulating the high-frequency tones with respective ones of the low-frequency signals, to provide N modulated high-frequency tones on the N separate transmission paths; and combining the N modulated high-frequency tones on a single output path.

7. A method as defined in claim 6, wherein the step of separating the N high-frequency tones comprises:

splitting the frequency-spaced high-frequency tones input along the single input into N parallel paths;

filtering each of the N parallel paths to be responsive only to a unique one of the high-frequency tones, wherein each of the N parallel paths is responsive to a different tone.

8. A method as defined in claim 7, wherein:

the filtering step comprises passing the high-frequency tones through a distributed Josephson inductance (DJI) transmission line designed to resonate at the frequency of one of the high-frequency tones.

9. A method as defined in claim 6, wherein:

the step of separating the N high-frequency tones comprises connecting the single input path to a string of cascaded directional filters, and each directional filter couples a selected one of the high-frequency tones to the output path and passes all others to a downstream directional filter; and the steps of inputting the low-frequency signals and modulating the high-frequency tones takes place in respective directional filters.

10. A method as defined in claim 9, wherein:

the directional filters each comprise at least one ring resonator formed from a distributed Josephson inductance (DJI) transmission line designed to resonate at the frequency of one of the high-frequency tones; and the step of inputting the low-frequency signals comprises coupling each of the signals to one of the ring resonators.

* * * * *